US011549303B2

(12) United States Patent
Morosawa et al.

(10) Patent No.: US 11,549,303 B2
(45) **Date of Patent: *Jan. 10, 2023**

(54) VEHICLE CONTROL DEVICE, VEHICLE CONTROL METHOD, AND RECORDING MEDIUM

(71) Applicant: HONDA MOTOR CO., LTD., Tokyo (JP)

(72) Inventors: Ryo Morosawa, Wako (JP); Haisong Liu, Wako (JP); Akira Nakajima, Wako (JP); Kenji Okuma, Wako (JP); Hiroaki Maruyama, Wako (JP); Yoshikazu Matsuo, Wako (JP); Shuto Higashi, Wako (JP); Fumiaki Yamaguchi, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 87 days.

This patent is subject to a terminal disclaimer.

(21) Appl. No.: 17/196,476

(22) Filed: Mar. 9, 2021

(65) Prior Publication Data

US 2021/0293073 A1 Sep. 23, 2021

(30) Foreign Application Priority Data

Mar. 18, 2020 (JP) ..... JP2020-048069

(51) Int. Cl.
*E05F 15/00* (2015.01)
*E05F 15/73* (2015.01)

(52) U.S. Cl.
CPC ..... *E05F 15/73* (2015.01); *E05F 2015/767* (2015.01); *E05Y 2400/525* (2013.01); *E05Y 2800/426* (2013.01); *E05Y 2900/531* (2013.01)

(58) Field of Classification Search
CPC ..... E05F 15/73; E05F 2015/767; E05Y 2400/525; E05Y 2800/426; E05Y 2900/531
(Continued)

(56) References Cited

U.S. PATENT DOCUMENTS 7,438,346 B1 * 10/2008 Breed ..... E05C 17/203 296/146.12
10,738,527 B2 * 8/2020 Tamura ..... B60R 25/2054
(Continued)

FOREIGN PATENT DOCUMENTS

| | | |
|---|---|---|
| CN | 207348671 | 5/2018 |
| JP | 2003-138817 A | 5/2003 |
| JP | 2018-193031 | 12/2018 |

OTHER PUBLICATIONS

Chinese Office Action dated Jun. 1, 2022, 8 pages.

*Primary Examiner* — Chi Q Nguyen
(74) *Attorney, Agent, or Firm* — Rankin, Hill & Clark LLP

(57) ABSTRACT

A vehicle control device includes a power door control unit that: when a getting-off-intention of a user is recognized by a getting-off-intention recognizing unit, determines whether a door-opening-prohibition condition of a predetermined door is satisfied based on a surrounding situation of a vehicle recognized by a vehicle-surrounding-situation recognizing unit; and executes power-door-automatic-opening control, the power-door-automatic-opening control causing a power door to perform an opening operation when the door-opening-prohibition condition is not satisfied, the power-door-automatic-opening control prohibiting the opening operation of the power door when the door-opening-prohibition condition is satisfied.

8 Claims, 7 Drawing Sheets

(58) Field of Classification Search
USPC ..... 49/31
See application file for complete search history.

(56) References Cited

U.S. PATENT DOCUMENTS

| | | | | |
|---|---|---|---|---|
| 2006/0164029 | A1* | 7/2006 | Suzuki | E05F 15/42 318/283 |
| 2009/0033256 | A1* | 2/2009 | Kamiya | B60J 5/06 49/31 |
| 2013/0025203 | A1* | 1/2013 | Ozaki | E05F 15/40 49/31 |
| 2015/0021931 | A1* | 1/2015 | Konchan | E05B 77/48 49/506 |
| 2016/0026191 | A1* | 1/2016 | Fujimoto | E05F 15/73 701/49 |
| 2016/0139652 | A1* | 5/2016 | Huang | G06F 13/4077 713/323 |
| 2016/0167621 | A1* | 6/2016 | Luu | B60R 25/2054 701/48 |
| 2018/0283081 | A1* | 10/2018 | Tamura | E05F 15/76 |
| 2020/0087965 | A1* | 3/2020 | Battlogg | E05F 5/00 |

* cited by examiner

VEHICLE CONTROL DEVICE, VEHICLE CONTROL METHOD, AND RECORDING MEDIUM

INCORPORATION BY REFERENCE

The present application claims priority under 35 U.S.C. § 119 to Japanese Patent Application No. 2020-048069 filed on Mar. 18, 2020. The content of the application is incorporated herein by reference in its entirety.

BACKGROUND OF THE INVENTION

Field of the Invention

The present invention relates to a vehicle control device, a vehicle control method, and a recording medium.

Description of the Related Art

Conventionally, a vehicle entry system of a vehicle using image authentication has been proposed (see, for example, Japanese Patent Laid-Open No. 2003-138817). The entry system is provided with peripheral monitoring means for detecting a person approaching the vehicle using radio waves, ultrasonic waves, infrared rays, or a peripheral image of the vehicle, and when it detects a person approaching the vehicle, it photographs the person to execute identity confirmation by his/her iris. Then, the above entry system unlocks the door of the vehicle when the person is confirmed to be the person himself/herself.

According to the conventional entry system, a user can unlock the door only by approaching the vehicle, so that a load on the user when getting on the vehicle can be reduced. Then, in order to improve the usability for the user to use the vehicle, it is desirable to reduce a load on the user not only when the user gets on the vehicle but also when the user gets off the vehicle.

The present invention has been made with respect to such a background, and an object of the present invention is to provide a vehicle control device, a vehicle control method, and a recording medium capable of reducing a load on a user when the user gets off a vehicle.

SUMMARY OF THE INVENTION

As a first aspect for achieving the object, there is provided a vehicle control device that controls an opening operation of a power door provided in a vehicle, the device including: a getting-off-intention recognizing unit that recognizes a getting-off-intention of a user in the vehicle; a vehicle-surrounding-situation recognizing unit that recognizes a surrounding situation of the vehicle; and a power door control unit that: when the getting-off-intention of the user is recognized by the getting-off-intention recognizing unit, determines whether a door-opening-prohibition condition of a predetermined door is satisfied based on the surrounding situation of the vehicle recognized by the vehicle-surrounding-situation recognizing unit; and executes power-door-automatic-opening control, the power-door-automatic-opening control causing the power door to perform the opening operation when the door-opening-prohibition condition is not satisfied, the power-door-automatic-opening control prohibiting the opening operation of the power door when the door-opening-prohibition condition is satisfied.

Here, the power door means a door that performs a closing operation by an electric actuator, a hydraulic actuator, or the like.

The vehicle control device may include: a line-of-sight recognizing unit that recognizes a line-of-sight direction of the user; and an action recognizing unit that recognizes an action of the user in an interior of the vehicle, wherein the getting-off-intention recognizing unit recognizes the getting-off-intention of the user when the line-of-sight recognizing unit recognizes that a line of sight of the user is directed to the power door and the action recognizing unit recognizes an action of the user toward the power door.

The vehicle control device may include: a parking-point recognizing unit that recognizes a point where the vehicle is parked, wherein the power door control unit executes the power-door-automatic-opening control when the parking-point recognizing unit recognizes that the vehicle is parked at a predetermined point, and the power door control unit prohibits execution of the power-door-automatic-opening control when the parking-point recognizing unit recognizes that the vehicle is parked at a position other than the predetermined point.

The vehicle control device may be configured such that an area including a home of the user is set as the predetermined point.

The vehicle control device may be configured such that the door-opening-prohibition condition is set to that the vehicle-surrounding-situation recognizing unit recognizes a person approaching the vehicle.

The vehicle control device may be configured such that the power door control unit executes the power-door-automatic-opening control after a power switch of the vehicle is turned off.

As a second aspect for achieving the above object, there is provided a vehicle control method executed by a computer to control an opening operation of a power door provided in a vehicle, the method including: a getting-off-intention recognizing step that recognizes a getting-off-intention of a user in the vehicle; a vehicle-surrounding-situation recognizing step that recognizes a surrounding situation of the vehicle; and a power door control step that: when the getting-off-intention of the user is recognized by the getting-off-intention recognizing step, determines whether a door-opening-prohibition condition of a predetermined door is satisfied based on the surrounding situation of the vehicle recognized by the vehicle-surrounding-situation recognizing step; and executes power-door-automatic-opening control, the power-door-automatic-opening control causing the power door to perform the opening operation when the door-opening-prohibition condition is not satisfied, the power-door-automatic-opening control prohibiting the opening operation of the power door when the door-opening-prohibition condition is satisfied.

As a third aspect for achieving the above object, there is provided a non-transient recording medium on which a vehicle control program is recorded, the program causing a computer to, in order to control an opening operation of a power door provided in a vehicle, function as: a getting-off-intention recognizing unit that recognizes a getting-off-intention of a user in the vehicle; a vehicle-surrounding-situation recognizing unit that recognizes a surrounding situation of the vehicle; and a power door control unit that: when the getting-off-intention of the user is recognized by the getting-off-intention recognizing unit, determines whether a door-opening-prohibition condition of a predetermined door is satisfied based on the surrounding situation of the vehicle recognized by the vehicle-surrounding-situation recognizing unit; and executes power-door-automatic-opening control, the power-door-automatic-opening control causing the power door to perform the opening operation when the door-opening-prohibition condition is not satisfied, the power-door-automatic-opening control prohibiting the opening operation of the power door when the door-opening-prohibition condition is satisfied.

According to the above vehicle control device, when the user in the vehicle indicates a getting-off-intention, the power door control unit causes the power door to perform the opening operation on condition that the door-opening-prohibition condition is not satisfied. This can reduce a load on the user when getting off the vehicle.

DETAILED DESCRIPTION OF THE PREFERRED EMBODIMENTS

1. Vehicle Configuration

Figure 1:
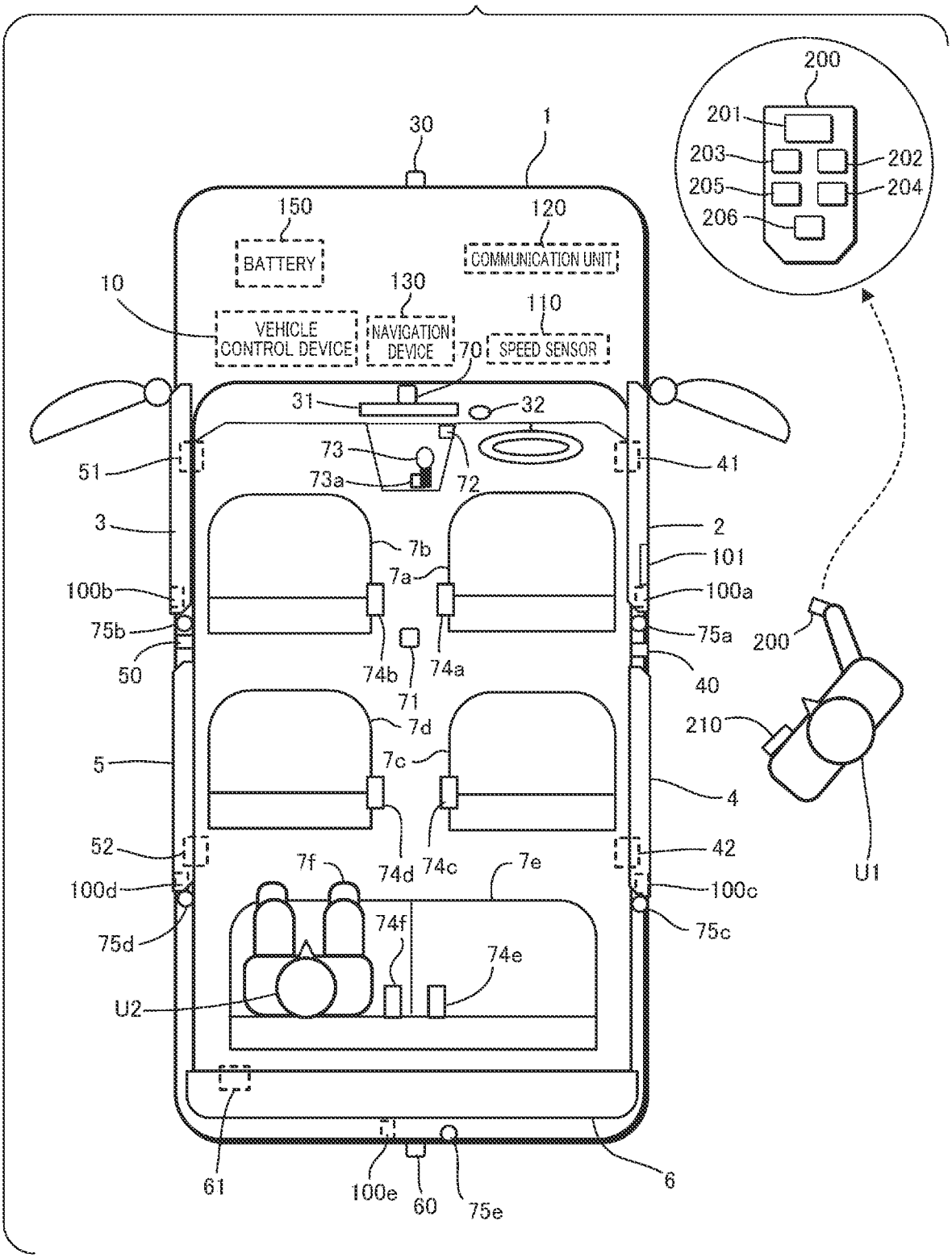
FIG. 1 is a configuration diagram of a vehicle equipped with a vehicle control device.

A configuration of a vehicle 1 equipped with a vehicle control device 10 of this embodiment is described below with reference to FIG. 1. As shown in FIG. 1, the vehicle 1 is a passenger car having a seating capacity of six people, and includes a driver's seat 7*a*, a front passenger seat 7*b*, a second row right seat 7*c*, a second row left seat 7*d*, a third row right seat 7*e*, and a third row left seat 7*f*. Respective seats 7*a* to 7*f* are provided with seatbelt switches 74*a* to 74*f* (not shown) for detecting whether each seatbelt is fastened.

The vehicle 1 includes a right power hinge door 2, a left power hinge door 3, a right power slide door 4, a left power slide door 5, and a power tailgate 6. The right power hinge door 2, the left power hinge door 3, the right power slide door 4, the left power slide door 5, and the power tailgate 6 correspond to power doors of the present invention. A door knob of the right power hinge door 2 is provided with a door touch sensor 101, and a user U1 who carries a portable key 200 of the vehicle 1 can unlock the doors 2 to 6 of the vehicle 1 by touching the door touch sensor 101.

The right power hinge door 2 includes a right PHD (Power Hinge Door) drive unit 41 that drives the right power hinge door 2 by an electric actuator (not shown) for opening and closing, and the left power hinge door 3 includes a left PHD drive unit 51 that drives the left power hinge door 3 by an electric actuator for opening and closing. The right power slide door 4 includes a right PSD (Power Slide Door) drive unit 42 that drives the right power slide door 4 by an electric actuator for opening and closing, and the left power slide door 5 includes a left PSD drive unit 52 that drives the left power slide door 5 by an electric actuator for opening and closing. The power tailgate 6 includes a PTG (Power Tail Gate) drive unit 61 that drives the power tailgate 6 by an electric actuator for opening and closing.

A front camera 30 for photographing the front of the vehicle 1 is provided at a front part of the vehicle 1, and a rear camera 60 for photographing the rear of the vehicle 1 is provided at a rear part of the vehicle 1. A right side camera 40 for photographing the right side of the vehicle 1 is provided on a right side part of the vehicle 1, and a left side camera 50 for photographing the left side of the vehicle 1 is provided on a left side part of the vehicle 1.

The dashboard of the vehicle interior is provided with a front-seat camera 70 for photographing users who sit on the driver's seat 7*a* and a front passenger seat 7*b*, a display 31, and a speaker 32. On the ceiling of the vehicle interior, there is provided a rear-seat camera 71 for photographing users who sit on the second row right seat 7*c*, the second row left seat 7*d*, the third row right seat 7*e*, and the third row left seat 7*f*.

The respective doors 2 to 5 are provided with door switches 75*a* to 75*d* for detecting the opening and closing of the doors. The power tailgate 6 is also provided with a door switch 75*e* for detecting the opening and closing of the power tailgate 6. Furthermore, a power switch 72 for instructing on and off of a battery 150 and a shift switch 73*a* for detecting a shift position of a shift lever 73 are provided near the driver's seat 7*a*. When the battery 150 is on, electric power is supplied from the battery 150 to a load 151 (see FIG. 2), and when the battery 150 is off, supply of electric power from the battery 150 to the load 151 is shut off. The load 151 includes an air conditioner (not shown), an electric motor, and the like provided in the vehicle 1.

Furthermore, the vehicle 1 includes: door lock mechanisms 100*a* to 100*e* for locking the respective doors 2 to 5 and the power tailgate 6; a speed sensor 110 for detecting a traveling speed of the vehicle 1; a communication unit 120 for communicating with a portable key 200, a user terminal 210, and the like; and a navigation device 130. The navigation device 130 has a GPS (Global Positioning System) sensor and map data (not shown), and executes route guidance to a destination based on the position of the vehicle 1 detected by the GPS sensor and the map data.

2. Vehicle Control Device Configuration

A configuration of the vehicle control device 10 is described below with reference to FIG. 2. The vehicle control device 10 includes an ECU (Electronic Control Unit) that is configured with a CPU (Central Processing Unit, which corresponds to a computer of the present invention and is not shown), a memory 80, an interface circuit (not shown), and the like, to control an operation of the vehicle 1.

The vehicle control device 10 receives input of images of the surroundings of the vehicle 1 taken by the front camera 30, the right side camera 40, the left side camera 50, and the rear camera 60. In addition, the vehicle control device 10 receives input of images of the vehicle interior taken by the front-seat camera 70 and the rear-seat camera 71.

Furthermore, the vehicle control device 10 receives input of: detection signals of the power switch 72, shift switch 73*a*, seatbelt switches 74*a* to 74*f*, and door switches 75*a* to 75*e*; and lock detection signals for the respective doors 2 to 5 and the power tailgate 6 by door lock sensors (not shown) provided in the door lock mechanisms 100*a* to 100*e*.

In addition, the vehicle control device 10 receives input of: a touch detection signal by the door touch sensor 101, a speed detection signal of the speed sensor 110; and information on the current position of the vehicle 1 detected by the navigation device 130.

Control signals output from the vehicle control device 10 control operations of: the right PHD drive unit 41; the right PSD drive unit 42; the left PHD drive unit 51; the left PSD drive unit 52; the PTG drive unit 61; the door lock mechanisms 100*a*-100*e*; and the battery 150. In addition, the control signals output from the vehicle control device 10 control screen display of the display 31, and the sound (voice guidance, chime sound, and so on) output from the speaker 32. The vehicle control device 10 communicates with the portable key 200 carried by the user U1 and the user terminal 210 via the communication unit 120.

The CPU reads and executes a control program 81 of the vehicle control device 10 stored in the memory 80 to function as: a key authentication unit 11; a user-getting-on recognizing unit 12; a parking-point recognizing unit 13; a line-of-sight recognizing unit 14; an action recognizing unit 15; a getting-off-intention recognizing unit 16; a vehicle-surrounding-situation recognizing unit 17; and a power door control unit 18. The control program 81 includes a vehicle control program of the present invention. The memory 80 stores an authentication ID code 82 used when the portable key 200 authenticates the user U1. The CPU corresponds to a computer. The memory 80 corresponds to a recording medium. The control program 81 may be recorded on an external recording medium (flash memory, magnetic disk, optical disk, etc.) that can be read and written by a computer, to be transferred from the external recording medium to the memory 80. The memory 80 and the external recording medium are non-transient tangible recording media.

A process executed by the getting-off-intention recognizing unit 16 corresponds to a getting-off-intention recognizing step in a vehicle control method of the present invention. A process executed by the vehicle-surrounding-situation recognizing unit 17 corresponds to a vehicle-surrounding-situation recognizing step in the vehicle control method of the present invention. A process executed by the power door control unit 18 corresponds to a power door control step in the vehicle control method of the present invention.

As shown in FIG. 1, when the user U1 who carries the portable key 200 approaches the vehicle 1, the key authentication unit 11 communicates with the portable key 200 via the communication unit 120, and receives an ID code from the portable key 200. Then, when the received ID code equals the authentication ID code 82 stored in the memory 80, the key authentication unit 11 permits the user U1 to use the vehicle 1. As a result, the user U1 can operate the vehicle 1.

As shown in FIG. 1, the portable key 200 includes: a lock-unlock button 201 for instructing lock and unlock of the vehicle 1; a right power hinge door button 202 for instructing opening and closing of the right power hinge door 2; a left power hinge door button 203 for instructing opening and closing of the left power hinge door 3; a right power slide door button 204 for instructing opening and closing of the right power slide door 4; a left power slide door button 205 for instructing opening and closing of the left power slide door 5; and a power tail gate button 206 for instructing the opening and closing of the power tailgate 6. Hereinafter, the right power hinge door 2, the left power hinge door 3, the right power slide door 4, the left power slide door 5, and the power tailgate 6 are also collectively referred to as electric doors.

The user U1 can operate the lock-unlock button 201 of the portable key 200 to unlock the respective doors 2 to 6 of the vehicle 1 and get on the vehicle 1. In addition, the user U1 can operate the buttons 202 to 206 of the portable key 200 to instruct the vehicle 1 to open and close the electric doors. The user U1 who carries the portable key 200 and gets on the vehicle 1 turns on the power switch 72 to start the vehicle 1 and starts using the vehicle 1.

When the portable key 200 is measured to be in the interior of the vehicle 1 by the communication status between the communication unit 120 and the portable key 200, the user-getting-on recognizing unit 12 recognizes that the user U1 is on the vehicle 1. Alternatively, the user-getting-on recognizing unit 12 may recognize that the user U1 is in the vehicle 1 when the user-getting-on recognizing unit 12 can identify the face image of the user U1 from the images taken by the front-seat camera 70 and the rear-seat camera 71. In addition, the user-getting-on recognizing unit 12 recognizes a user U2 who is in the vehicle 1 from the images taken by the front-seat camera 70 and the rear-seat camera 71.

The parking-point recognizing unit 13 recognizes the point where the vehicle 1 is parked based on the current position information of the vehicle 1 detected by the navigation device 130 and the map information stored in the navigation device 130. The line-of-sight recognizing unit 14 recognizes the line-of-sight direction of the users U1 and U2 in the vehicle 1 from the face images of the users U1 and U2 taken by the front-seat camera 70 or the rear-seat camera 71. The action recognizing unit 15 recognizes the actions of the users U1 and U2 in the vehicle 1 from the moving images of the users U1 and U2 taken by the front-seat camera 70 or the rear-seat camera 71. The action recognizing unit 15 recognizes, for example, the gestures of the users U1 and U2, the change in the direction of the body, the direction of movement, and the like, as the actions of the users U1 and U2.

The getting-off-intention recognizing unit 16 recognizes the getting-off-intention of the users U1 and U2 from the vehicle 1 based on the line-of-sight directions of the users U1 and U2 recognized by the line-of-sight recognizing unit 14, and the actions of the users U1 and U2 recognized by the action recognizing unit 15. Specifically, the getting-off-intention recognizing unit 16 recognizes the getting-off-intention of the user U1 when the line-of-sight recognizing unit 14 recognizes that the line of sight of the user U1 is directed to any of the power doors, and the action recognizing unit 15 recognizes the action toward the power door to which the user U1 directs the line of sight.

The action recognizing unit 15 recognizes an action by the user U1, such as turning the body toward the power door, bringing the body closer to the power door, or moving from the seat toward the power door, as an action of the user U1 toward the power door. The getting-off-intention recognizing unit 16 also recognizes the getting-off-intention from the vehicle 1 of the user U2 in the same manner. The vehicle-surrounding-situation recognizing unit 17 recognizes a surroundings situation of the vehicle 1 based on the images taken by the front camera 30, the right side camera 40, the left side camera 50, and the rear camera 60.

Figure 3:
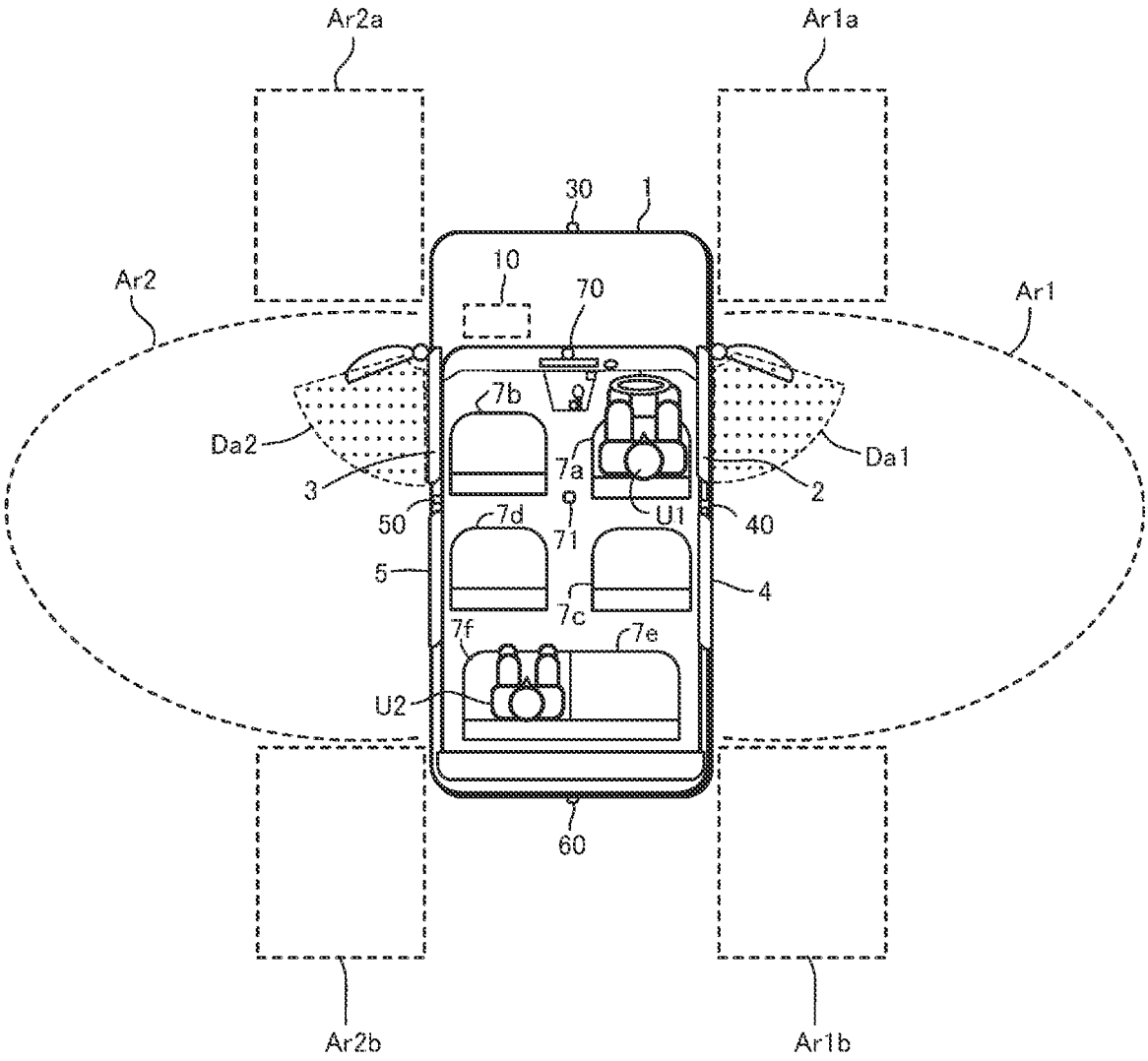
FIG. 3 is an explanatory diagram of a monitoring range by a right side camera and a left side camera.

Here, FIG. 3 shows a photographing range Ar1 of the right side camera 40 and a photographing range Ar2 of the left side camera 50. The vehicle-surrounding-situation recognizing unit 17 recognizes obstacles, pedestrians, other vehicles, and the like existing in Ar1 and Ar2, from the images taken by the right side camera 40 and the left side camera 50. Da1 in FIG. 3 is a movable range of the right power hinge door 2, and Da2 in FIG. 3 is a movable range of the left power hinge door 3.

Note that the vehicle-surrounding-situation recognizing unit 17 may use the images taken by the front camera 30 and the rear camera 60, or separately include a sonar sensor or the like, to extend the vehicle surrounding situation recognition range to a range including Ar1*a*, Ar1*b*, Ar2*a*, and Ar2*b*. Alternatively, the vehicle-surrounding-situation recognizing unit 17 may utilize a camera with a wide angle of view and a high number of pixels to set the recognition range of the right side camera to include Ar1, Ar1*a*, and Ar1*b*, and to set the recognition range of the left side camera 50 to include Ar2, Ar2*a*, and Ar2*b*.

When the getting-off-intention recognizing unit 16 recognizes the getting-off-intention of the user U1 who is in the vehicle 1, the power door control unit 18 specifies the power door to be used by the user U1 for getting off based on the getting-off-intention. Then, the power door control unit 18 determines whether a door-opening-prohibition condition is satisfied based on the surrounding situation of the vehicle 1 recognized by the vehicle-surrounding-situation recognizing unit 17. The power door control unit 18 subsequently executes power-door-automatic-opening control: to open the specified power door when the door-opening-prohibition condition is not satisfied; and to prohibit the opening operation of the specified power door when the door opening prohibition condition is satisfied. Similarly, the power door control unit 18 also executes the power-door-automatic-opening control for the user U2 when the getting-off-intention recognizing unit 16 recognizes getting-off-intention of the user U2.

3. Door-Opening-Prohibition Condition

Figure 4:
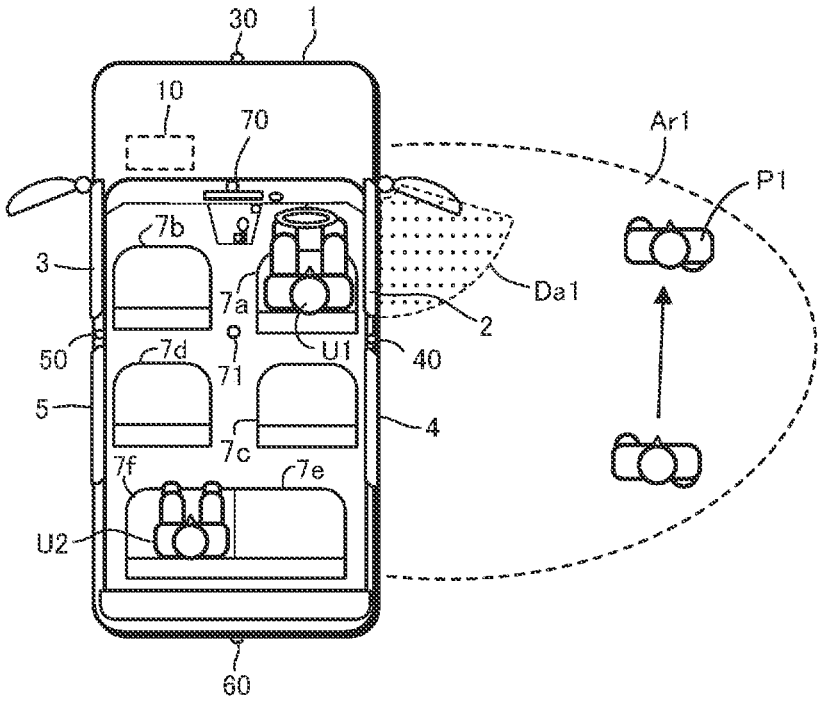
FIG. 4 is an explanatory diagram of determining whether a power door can perform an opening operation for a pedestrian passing by a side of the vehicle.
Figure 5:
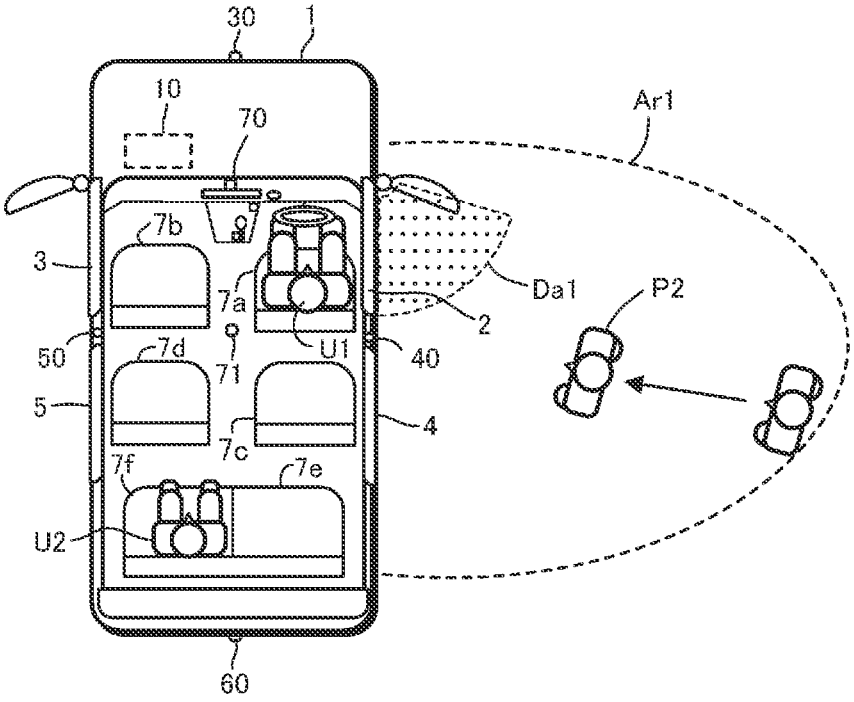
FIG. 5 is an explanatory diagram of determining whether the power door can perform the opening operation for a pedestrian approaching a vehicle.

The door-opening-prohibition condition used by the power door control unit 18 is described below with reference to FIGS. 4 to 6. With reference to FIG. 4, a door-opening-prohibition condition for the right power hinge door 2 is set to that the vehicle-surrounding-situation recognizing unit 17 recognizes an obstacle in the movable range Da1. Similarly, a door opening prohibition condition is set for the left power hinge door 3.

In addition, a door-opening-prohibition condition for the right power hinge door 2 and the right power slide door 4 is set to that the vehicle-surrounding-situation recognizing unit 17 recognizes a pedestrian approaching the vehicle 1 within the photographing range Ar1 of the right side camera 40. In this case, as shown in FIG. 4, if the pedestrian P1 passing through Ar1 without facing the vehicle 1 is recognized, the door-opening-prohibition condition is not satisfied. On the other hand, as shown in FIG. 5, when the pedestrian P2 approaching the vehicle 1 in Ar1 is recognized, the door-opening-prohibition condition is satisfied. Similarly, a door-opening-prohibition condition is set for the left power hinge door 3 and the left power slide door 5.

Figure 6:
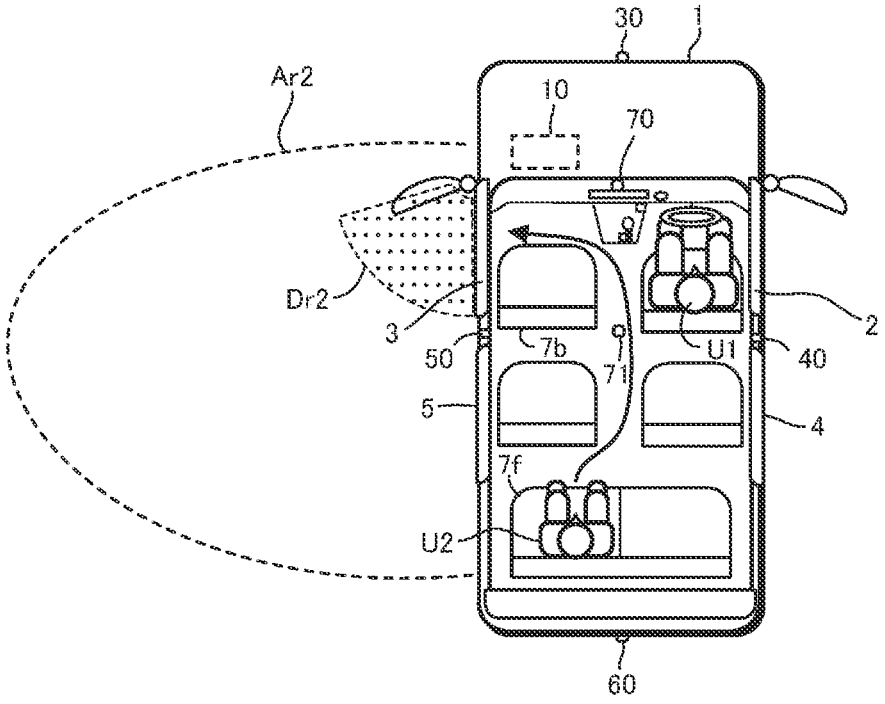
FIG. 6 is an explanatory diagram of control of the opening operation of the power door for a case in which a user in a third row seat indicates a getting-off-intention from a door of a front passenger seat.

In addition, FIG. 6 shows a situation in which the user U2 (for example, an infant) seated in the third row left seat 7*f* directs the line-of-sight to the left power hinge door 3, stands up from the third row left seat 7*f*, and starts walking toward the front passenger seat 7*b*. In this case, the getting-off-intention recognizing unit 16 recognizes the getting-off-intention of the user U2 from the left power hinge door 3, and the power door control unit 18 executes the power-door-automatic-opening control to determine whether the door-opening-prohibition condition for the left power hinge door 3 is satisfied in the same manner as in the case of the right power hinge door 2 described above.

Then, the getting-off-intention recognizing unit 16 causes the left power hinge door 3 to perform the opening operation when the door-opening-prohibition condition for the left power hinge door 3 is not satisfied, and it prohibits the opening operation of the left power hinge door 3 when the door-opening-prohibition condition for the left power hinge door 3 is satisfied.

In addition, a door-opening-prohibition condition for the power tailgate 6 is set to that the vehicle-surrounding-situation recognizing unit 17 recognizes an obstacle within the photographing range of the rear camera 60 from the image taken by the rear camera 60. Furthermore, the door-opening-prohibition condition for the power tailgate 6 is set to that the vehicle-surrounding-situation recognizing unit 17 recognizes a pedestrian approaching the vehicle 1 within the photographing range of the rear camera 60 from the image taken by the rear camera 60.

4. Power-Door-Opening Control

A series of power-door-opening control processes executed by the power door control unit 18 is described below with reference to a flowchart shown in FIG. 7. Here, as shown in FIGS. 4 to 5, a case is described in which the power-door-opening control is executed for the user U1 sitting on the driver's seat 7*a*.

Figure 7:
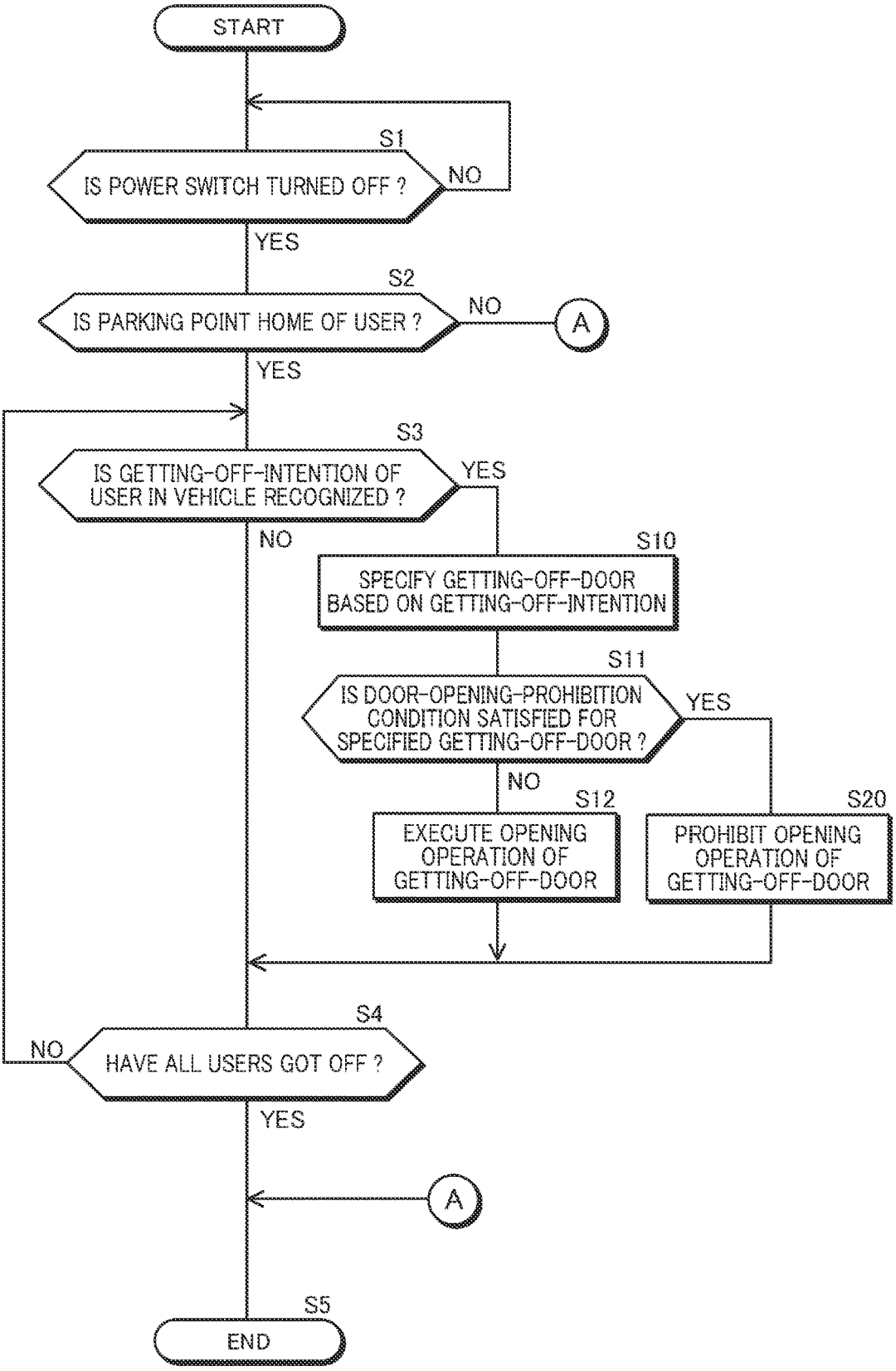
FIG. 7 is a flowchart of power-door-automatic-opening control.

In step S1 of FIG. 7, the power door control unit 18 advances the process to step S2 when the power switch 72 is turned off by the user U1 who is in the vehicle 1. In step S2, the power door control unit 18 determines whether the parking point of the vehicle 1 recognized by the parking-point recognizing unit 13 is a home of the user U1. Then, the power door control unit 18 advances the process to step S3 when the parking point of the vehicle 1 is the home of the user U1. On the other hand, when the parking point of the vehicle 1 is not the home of the user U1, the power door control unit 18 advances the process to step S5, and in this case, the power-door-opening control by the processes of step S3 and the subsequent steps are not executed.

In this case, the home of the user U1 is included in an area including the home of the user U1, and corresponds to a predetermined point of the present invention. The predetermined point may be set to a place other than the area including the home of the user U1 where it is expected that there is no problem with causing the power door to perform the opening operation because it is well monitored, such as an entrance of an accommodation facility. Setting the predetermined point in this way can prevent the power door of the vehicle 1 from being inadvertently opened because the power-door-opening control is executed while the vehicle 1 is parked at a place other than the predetermined point, such as a place where an unspecified large number of pedestrians come and go, for example, a downtown area.

In step S3, the power door control unit 18 determines whether the getting-off-intention recognizing unit 16 recognizes the getting-off-intention of the user U1 from the vehicle 1. Then, the power door control unit 18 advances the process to step S10 when the getting-off-intention of the user U1 from the vehicle 1 is recognized, and it advances the process to step S4 when the getting-off-intention of user U1 from the vehicle 1 is not recognized.

In step S10, the power door control unit 18 specifies a getting-off-door that is a door used by the user U1 to get off, based on the getting-off-intention of the user U1. In following step S11, the power door control unit 18 determines whether the door-opening-prohibition condition is satisfied for the specified getting-off-door. Then, when the door-opening-prohibition condition is not satisfied for the specified getting-off-door, the power door control unit 18 advances the process to step S20 to causes the getting-off-door to execute the opening operation, and advances the process to step S4. As a result, the user U1 can automatically open the right power hinge door 2 simply by directing his/her line-of-sight and body to the right power hinge door 2 to indicate his/her getting-off-intention, which can reduce the load on the user U1 when getting off.

On the other hand, when the door-opening-prohibition condition is satisfied for the getting-off-door, the power door control unit 18 advances the process to step S20 to prohibit the opening operation of the getting-off-door, and advances the process to step S4. As a result, when there is a pedestrian P2 approaching the vehicle 1 as shown in FIG. 5, or when there is an obstacle in the movable range Da1 of the right power hinge door 2, the right power hinge door 2 is prevented from performing the opening operation. In this case, the display on the display 31 or the output of the voice guidance from the speaker 32 may notify the user U1 that the automatic opening operation of the right power hinge door 2 is prohibited.

In step S4, the power door control unit 18 determines whether all the users who has been in the vehicle 1 get off the vehicle 1 based on the images taken by the front-seat camera 70 and the rear-seat camera 71. Then, the power door control unit 18 advances the process to step S5 to end the processes of the power-door-opening control when all the users get off the vehicle 1. On the other hand, when another user remains in the vehicle 1, the power door control unit 18 advances the process to step S3, and re-executes the processes of step S3 and the subsequent steps for the other user.

5. Other Embodiments

In the above embodiment, the getting-off-intention recognizing unit 16 recognizes the getting-off-intention of the user U1 based on the line-of-sight direction of the user U1 recognized by the line-of-sight recognizing unit 14 and the action of the user U1 recognized by the action recognizing unit 15. As another embodiment, the getting-off-intention recognizing unit 16 may recognize the getting-off-intention of the user U1 based only on the line-of-sight direction of the user U1 recognized by the line-of-sight recognizing unit 14, or based only on the action of the user U1 recognized by the action recognizing unit 15. In addition, the getting-off-intention recognizing unit 16 may recognize the getting-off-intention of the user U1 by factors other than the line-of-sight direction and action of the user U1.

In the above embodiment, the power door control unit 18 determines whether the parking point of the vehicle 1 is the home of the user U1 in step S2 of FIG. 7, and specifies the getting-off-door and causes the getting-off-door to perform the opening operation when the parking point of vehicle 1 is the home of the user U1. Another embodiment may have a configuration such that the parking-point recognizing unit 13 may be omitted.

In the above embodiment, the power door control unit 18 executes the processes of step S2 and subsequent steps when the power switch 72 is turned off in step S1 of FIG. 7, but the determination in step S1 may be omitted.

In the above embodiment, the rear-seat camera 71 is provided on the ceiling of the vehicle interior, but the rear-seat camera 71 may be provided at a position of a rear-view mirror (not shown), a headrest or a seat back of each seat, or the like.

Figure 2:
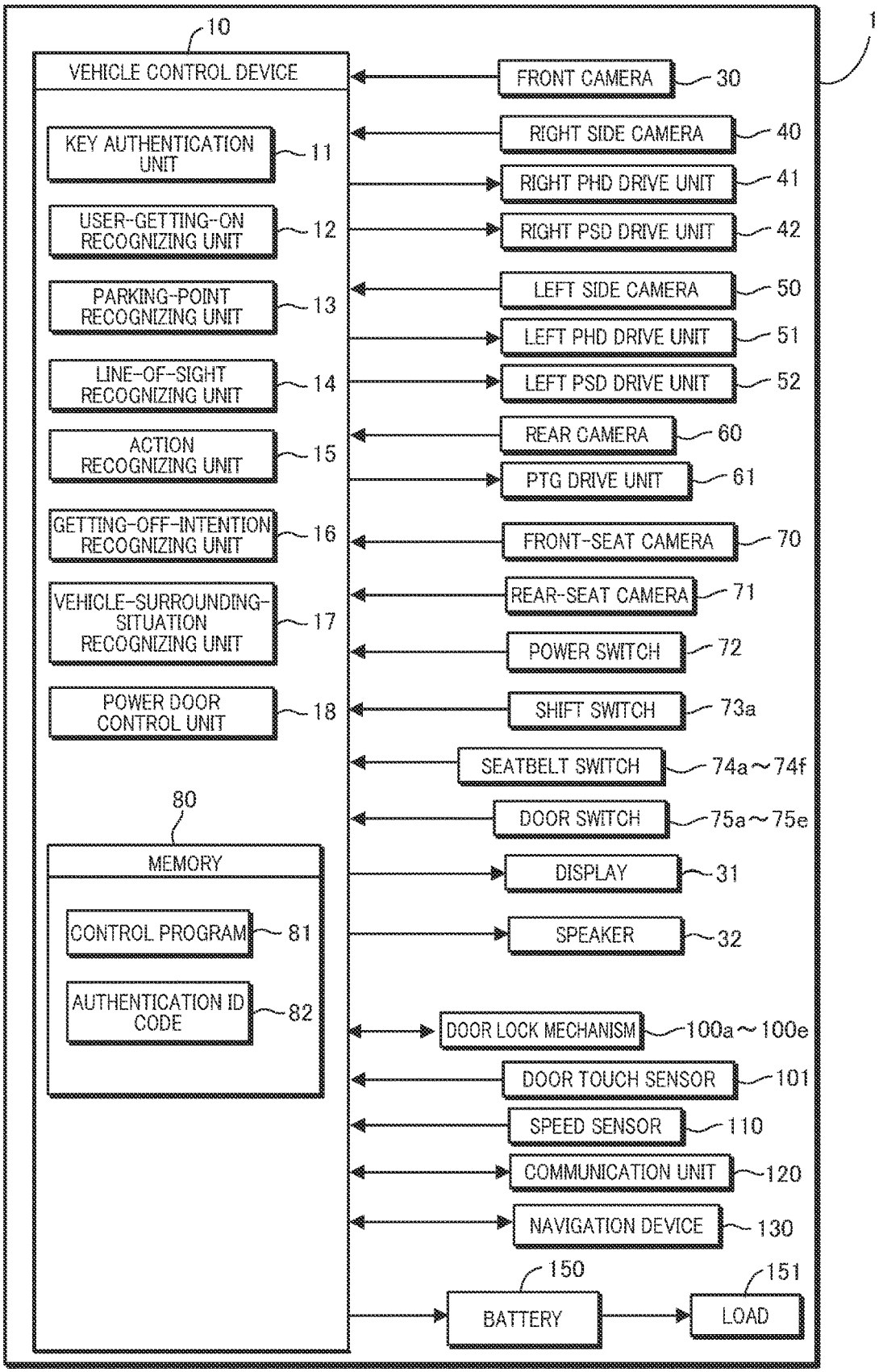
FIG. 2 is a configuration diagram of the vehicle control device.

Note that, FIGS. 1 and 2 are schematic diagrams showing the configurations of the vehicle 1 and the vehicle control device 10 classified according to what is mainly in the process in order to facilitate understanding of the invention of the application, and the configurations of the vehicle 1 and the vehicle control device 10 may be configured by other classification. In addition, the process of each component may be executed by one hardware unit, or may be executed by a plurality of hardware units. In addition, the process by each component shown in FIG. 7 may be executed by one program or may be executed by a plurality of programs.

6. Configurations Supported by the Above Embodiments

The above embodiments are specific examples of the following configurations.

Item 1

A vehicle control device that controls an opening operation of a power door provided in a vehicle, the device including: a getting-off-intention recognizing unit that recognizes a getting-off-intention of a user in the vehicle; a vehicle-surrounding-situation recognizing unit that recognizes a surrounding situation of the vehicle; and a power door control unit that: when the getting-off-intention of the user is recognized by the getting-off-intention recognizing unit, determines whether a door-opening-prohibition condition of a predetermined door is satisfied based on the surrounding situation of the vehicle recognized by the vehicle-surrounding-situation recognizing unit; and executes power-door-automatic-opening control, the power-door-automatic-opening control causing the power door to perform the opening operation when the door-opening-prohibition condition is not satisfied, the power-door-automatic-opening control prohibiting the opening operation of the power door when the door-opening-prohibition condition is satisfied.

According to the above vehicle control device of item 1, when the user in the vehicle indicates the getting-off-intention, the power door control unit causes the power door to perform the opening operation on condition that the door-opening-prohibition condition is not satisfied. This can reduce a load on the user when getting off the vehicle.

Item 2

The vehicle control device according to item 1, including: a line-of-sight recognizing unit that recognizes a line-of-sight direction of the user; and an action recognizing unit that recognizes an action of the user in an interior of the vehicle, wherein the getting-off-intention recognizing unit recognizes the getting-off-intention of the user when the line-of-sight recognizing unit recognizes that a line of sight of the user is directed to the power door and the action recognizing unit recognizes an action of the user toward the power door.

According to the vehicle control device of item 2, opening the door where the user is about to get off can improve convenience of the user.

Item 3

The vehicle control device according to item 1 or 2, including a parking-point recognizing unit that recognizes a point where the vehicle is parked, wherein the power door control unit executes the power-door-automatic-opening control when the parking-point recognizing unit recognizes that the vehicle is parked at a predetermined point, and the power door control unit prohibits execution of the power-door-automatic-opening control when the parking-point recognizing unit recognizes that the vehicle is parked at a position other than the predetermined point.

According to the vehicle control device of item 3, for example, a predetermined point is set to a place where a monitoring system works well, such as an entrance of an accommodation facility, so that the power-door-automatic-opening control can be prohibited from execution of the power-door-automatic-opening control at a point other than the predetermined point. This can prevent the power door from being inadvertently opened by execution of the power-door-automatic-opening control when the vehicle is parked at a point other than the predetermined point, for example, in a downtown area where an unspecified large number of people come and go.

Item 4

The vehicle control device according to item 3, wherein an area including a home of the user is set as the predetermined point.

According to the vehicle control device of item 4, only when the vehicle is parked in the area including the home and there is little risk in which suspicious persons near the vehicle approach the vehicle, the power door control unit can execute the power-door-automatic-opening control.

Item 5

The vehicle control device according to any one of items 1 to 4, wherein the door-opening-prohibition condition is set to that the vehicle-surrounding-situation recognizing unit recognizes a person approaching the vehicle.

According to the vehicle control device of item 5, when there is a person approaching the vehicle, the power-door-automatic-opening control can be prevented from being executed to open the power door.

Item 6

The vehicle control device according to any one of items 1 to 5, wherein the power door control unit executes the power-door-automatic-opening control after a power switch of the vehicle is turned off.

According to the vehicle control device of item 6, when it is expected that the user ends the use of the vehicle by turning off the power switch, the power door automatic control can cause the power door to perform the opening operation to allow the user to easily get off the vehicle.

Item 7

A vehicle control method executed by a computer to control an opening operation of a power door provided in a vehicle, the method including: a getting-off-intention recognizing step that recognizes a getting-off-intention of a user in the vehicle; a vehicle-surrounding-situation recognizing step that recognizes a surrounding situation of the vehicle; and a power door control step that: when the getting-off-intention of the user is recognized by the getting-off-intention recognizing step, determines whether a door-opening-prohibition condition of a predetermined door is satisfied based on the surrounding situation of the vehicle recognized by the vehicle-surrounding-situation recognizing step; and executes power-door-automatic-opening control, the power-door-automatic-opening control causing the power door to perform the opening operation when the door-opening-prohibition condition is not satisfied, the power-door-automatic-opening control prohibiting the opening operation of the power door when the door-opening-prohibition condition is satisfied.

Executing the vehicle control method of item 7 by a computer enables obtaining the same function effect as the vehicle control device of item 1.

Item 8

A non-transient recording medium on which a vehicle control program is recorded, the program causing a computer to, in order to control an opening operation of a power door provided in a vehicle, function as: a getting-off-intention recognizing unit that recognizes a getting-off-intention of a user in the vehicle; a vehicle-surrounding-situation recognizing unit that recognizes a surrounding situation of the vehicle; and a power door control unit that: when the getting-off-intention of the user is recognized by the getting-off-intention recognizing unit, determines whether a door-opening-prohibition condition of a predetermined door is satisfied based on the surrounding situation of the vehicle recognized by the vehicle-surrounding-situation recognizing unit; and executes power-door-automatic-opening control, the power-door-automatic-opening control causing the power door to perform the opening operation when the door-opening-prohibition condition is not satisfied, the power-door-automatic-opening control prohibiting the opening operation of the power door when the door-opening-prohibition condition is satisfied.

Causing a computer to execute the vehicle control program of item 8 can realize the configuration of the vehicle control device of item 1.

REFERENCE SIGNS LIST

1 vehicle
2 right power hinge door
3 left power hinge door
4 right power slide door
5 left power slide door
6 power tailgate
10 vehicle control device
11 key authentication unit
12 user-getting-on recognizing unit
13 parking-point recognizing unit
14 line-of-sight recognizing unit
15 action recognizing unit
16 getting-off-intention recognizing unit
17 vehicle-surrounding-situation recognizing unit
18 power door control unit
20 memory
21 control program
72 power switch
73*a* shift switch
74*a*-74*e* seatbelt switch
75*a*-75*e* door switch
100*a*-100*e* door lock mechanism
101 door touch sensor
110 speed sensor
120 communication unit
130 navigation device
150 battery

What is claimed is:

1. A vehicle control device that controls an opening operation of a power door provided in a vehicle, the device comprising a central processing unit (CPU) that includes:

a getting-off-intention recognizing unit that recognizes a getting-off-intention of a user in the vehicle;

a vehicle-surrounding-situation recognizing unit that recognizes a surrounding situation of the vehicle; and a power door control unit that: upon the getting-off-intention of the user being recognized by the getting-off-intention recognizing unit, determines whether a door-opening-prohibition condition of a predetermined door is satisfied based on the surrounding situation of the vehicle recognized by the vehicle-surrounding-situation recognizing unit; and executes power-door-automatic-opening control, the power-door-automatic-opening control causing the power door to perform the opening operation upon the door-opening-prohibition condition being not satisfied, the power-door-automatic-opening control prohibiting the opening operation of the power door upon the door-opening-prohibition condition being satisfied.

2. The vehicle control device according to claim 1, wherein the CPU further includes:

a line-of-sight recognizing unit that recognizes a line-of-sight direction of the user; and an action recognizing unit that recognizes an action of the user in an interior of the vehicle, wherein the getting-off-intention recognizing unit recognizes the getting-off-intention of the user upon the line-of-sight recognizing unit recognizing that a line of sight of the user is directed to the power door and the action recognizing unit recognizes an action of the user toward the power door.

3. The vehicle control device according to claim 1, wherein the CPU further includes a parking-point recognizing unit that recognizes a point where the vehicle is parked, wherein the power door control unit executes the power-door-automatic-opening control upon the parking-point recognizing unit recognizing that the vehicle is parked at a predetermined point, and the power door control unit prohibits execution of the power-door-automatic-opening control upon the parking-point recognizing unit recognizing that the vehicle is parked at a position other than the predetermined point.

4. The vehicle control device according to claim 3, wherein an area including a home of the user is set as the predetermined point.

5. The vehicle control device according to claim 1, wherein the door-opening-prohibition condition is set to that the vehicle-surrounding-situation recognizing unit recognizes a person approaching the vehicle.

6. The vehicle control device according to claim 1, wherein the power door control unit executes the power-door-automatic-opening control after a power switch of the vehicle is turned off.

7. A vehicle control method executed by a computer to control an opening operation of a power door provided in a vehicle, the method comprising:

a getting-off-intention recognizing step that recognizes a getting-off-intention of a user in the vehicle;

a vehicle-surrounding-situation recognizing step that recognizes a surrounding situation of the vehicle; and a power door control step that: upon the getting-off-intention of the user being recognized by the getting-off-intention recognizing step, determines whether a door-opening-prohibition condition of a predetermined door is satisfied based on the surrounding situation of the vehicle recognized by the vehicle-surrounding-situation recognizing step; and executes power-door-automatic-opening control, the power-door-automatic-opening control causing the power door to perform the opening operation upon the door-opening-prohibition condition being not satisfied, the power-door-automatic-opening control prohibiting the opening operation of the power door upon the door-opening-prohibition condition being satisfied.

8. A non-transient recording medium recording a vehicle control program, the program causing a computer to, in order to control an opening operation of a power door provided in a vehicle, function as:

a getting-off-intention recognizing unit that recognizes a getting-off-intention of a user in the vehicle;

a vehicle-surrounding-situation recognizing unit that recognizes a surrounding situation of the vehicle; and a power door control unit that: upon the getting-off-intention of the user being recognized by the getting-off-intention recognizing unit, determines whether a door-opening-prohibition condition of a predetermined door is satisfied based on the surrounding situation of the vehicle recognized by the vehicle-surrounding-situation recognizing unit; and executes power-door-automatic-opening control, the power-door-automatic-opening control causing the power door to perform the opening operation upon the door-opening-prohibition condition being not satisfied, the power-door-automatic-opening control prohibiting the opening operation of the power door upon the door-opening-prohibition condition being satisfied.

* * * * *